US009182692B2

(12) United States Patent
Takahashi et al.

(10) Patent No.: US 9,182,692 B2
(45) Date of Patent: Nov. 10, 2015

(54) BRIGHTNESS TONER, DEVELOPMENT, TONER CARTRIDGE, PROCESS CARTRIDGE, IMAGE FORMING APPARATUS, AND METHOD FOR PRODUCING THE BRIGHTNESS TONER

(75) Inventors: Masaru Takahashi, Kanagawa (JP); Shotaro Takahashi, Kanagawa (JP); Atsushi Sugitate, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/364,095

(22) Filed: Feb. 1, 2012

(65) Prior Publication Data

US 2013/0078562 A1 Mar. 28, 2013

(30) Foreign Application Priority Data

Sep. 28, 2011 (JP) ..... 2011-211950

(51) Int. Cl.

| | |
|---|---|
| ***G03G 9/00*** | (2006.01) |
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08708* (2013.01); *G03G 9/0819* (2013.01); *G03G 9/08755* (2013.01); *G03G 9/0926* (2013.01)

(58) Field of Classification Search

CPC .... G03G 9/0902; G03G 9/0926; G03G 9/087
USPC ..... 430/105, 108.6, 109.1, 110.3
See application file for complete search history.

(56) References Cited

U.S. PATENT DOCUMENTS

| | | | | |
|---|---|---|---|---|
| 7,010,256 | B2 | 3/2006 | Usui et al. | |
| 7,835,654 | B2 | 11/2010 | Fujimoto | |
| 2002/0192585 | A1* | 12/2002 | Brenner et al. | 430/108.6 |
| 2007/0025784 | A1 | 2/2007 | Ito et al. | |
| 2007/0072103 | A1* | 3/2007 | Kawamura et al. | 430/108.2 |
| 2007/0207397 | A1* | 9/2007 | Julien | 430/107.1 |
| 2009/0288580 | A1 | 11/2009 | Cai | |
| 2010/0215417 | A1* | 8/2010 | Fujimori | 399/346 |
| 2010/0330487 | A1 | 12/2010 | Veregin et al. | |
| 2011/0318683 | A1* | 12/2011 | Kadokura et al. | 430/105 |

FOREIGN PATENT DOCUMENTS

| | | |
|---|---|---|
| EP | 1 176 470 A2 | 1/2002 |
| EP | 1496406 | 1/2005 |

(Continued)

OTHER PUBLICATIONS

Australian Office Action dated Nov. 23, 2012 issued by the Australian Patent Office in corresponding Australian Patent Application No. 2012200768, pp. 1-4.

(Continued)

*Primary Examiner* — Thorl Chea
(74) *Attorney, Agent, or Firm* — Sughrue Mion, PLLC

(57) ABSTRACT

An electrostatic image developing toner including: first toner particles which contain a first binder resin and a brightness pigment; and second toner particles which contain a second binder resin and do not contain a brightness pigment, wherein the proportion of the second toner particles is in a range from 5% by number to 80% by number with respect to a total number of all toner particles.

10 Claims, 3 Drawing Sheets

(56) References Cited

FOREIGN PATENT DOCUMENTS

| | | | |
|---|---|---|---|
| EP | 2047335 | B1 | 5/2011 |
| JP | 62-067558 | A | 3/1987 |
| JP | 62-100769 | A | 5/1987 |
| JP | 2010-256613 | A | 11/2010 |
| WO | 2009026360 | A2 | 2/2009 |

OTHER PUBLICATIONS

Australian Office Action dated Jul. 14, 2014 issued by Australian Patent Office in counterpart Australian application No. 2013213711.
Office Action dated Nov. 20, 2014 issued by the Australian Government IP Australia in counterpart Australian Patent Application No. 2013213711.

* cited by examiner

BRIGHTNESS TONER, DEVELOPMENT, TONER CARTRIDGE, PROCESS CARTRIDGE, IMAGE FORMING APPARATUS, AND METHOD FOR PRODUCING THE BRIGHTNESS TONER

CROSS-REFERENCE TO RELATED APPLICATION(S)

This Application is based on and claims priority under 35 U.S.C. §119 from Japanese Patent Application No. 2011-211950 filed on Sep. 28, 2011.

BACKGROUND

1. Technical Field

The present invention relates to a brightness toner, a developer, a toner cartridge, a process cartridge, an image forming apparatus, and a method for producing the brightness toner.

2. Description of the Related Art

Brightness toners are used for the purpose of forming brightness images that glitter like a metallic gloss.

SUMMARY (1) An electrostatic image developing toner including: first toner particles which contain a first binder resin and a brightness pigment; and second toner particles which contain a second binder resin and do not contain a brightness pigment, wherein a proportion of the second toner particles is in a range from 5% by number to 80% by number with respect to a total number of all toner particles.

BRIEF DESCRIPTION OF THE DRAWINGS

Exemplary embodiments of the present invention will be described in detail based on the following figures, wherein.

DETAILED DESCRIPTION

Figure 1:
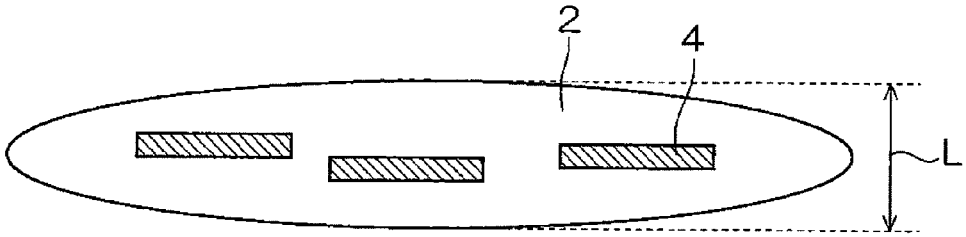
FIG. 1 is a cross-sectional view schematically illustrating an example of a toner particle according to the present exemplary embodiment.

Exemplary embodiments of the brightness toner, the developer, the toner cartridge, the process cartridge, the image forming apparatus and the method for producing the brightness toner according to the invention will now be described in detail.

<Brightness Toner>

In the brightness toner of the present exemplary embodiment, when the cross sections of the individual toner particles are observed to determine whether a brightness pigment is present or absent in the toner particles, the proportion of toner particles not including the brightness pigment is in the range from 5% by number to 80% by number with respect to the total number of all toner particles.

In the present exemplary embodiment, the term 'toner particles" refers to resin particles including a binder resin, and optionally additives, such as a coloring agent (e.g., a brightness pigment), a release agent and an external additive, and the term "toner" refers to an aggregate of the toner particles.

The brightness toner of the present exemplary embodiment has good transferability. The reason for this is unclear but is inferred as follows.

Since a brightness pigment has a large particle diameter and is flat in shape, toner particles including the brightness pigment are flat in shape, too. In contrast, toner particles not including a brightness pigment are substantially spherical in shape, unlike toner particles including a brightness pigment. Flat-shaped toner particles have a large contact area with a member, such as an intermediate transfer member. For this reason, when a number of images having a low printing area are printed using the flat-shaped toner particles, particularly, under a high temperature of about 32° C. and a high humidity of about 80% RH, the non-electrostatic adhesive strength between the toner particles and the member increases, resulting in deterioration of transfer efficiency. In this case, glitter of the images is deteriorated. Incidentally, an external additive may be attached to toner particles to achieve improved transferability. In this case, the external additive is buried in the toner particles when a number of images having a low printing area are printed using the toner particles, thereby resulting in little improvement in transferability.

In the present exemplary embodiment, the proportion of toner particles not including the brightness pigment with respect to the total number of all toner particles is limited to the range from 5% by number to 80% by number. By specifying the proportion of toner particles (i.e. spherical toner particles) not including the brightness pigment in the brightness toner of the present exemplary embodiment to the predetermined range, the spherical toner particles not including the brightness pigment are interposed between flat-shaped toner particles including a brightness pigment and a member, such as an intermediate transfer member. A small contact area between the spherical toner particles and the member makes it difficult to expect an increase in non-electrostatic adhesive strength between the spherical toner particles and the member even under high temperature and high humidity conditions. For this reason, it can be inferred that the interposition of the spherical toner particles between the flat toner particles and the member improves the transferability of the toner particles, and as a result, deterioration of glitter is prevented.

In the present exemplary embodiment, the proportion of toner particles not including the brightness pigment with respect to the total number of all toner particles refers to a value obtained by the following method.

Initially, the toner particles are embedded by using a bisphenol A type liquid epoxy resin and a curing agent to prepare a sample for cutting. Subsequently, the sample is cut using a saw with a diamond knife, for example LEICA ultramicrotome (manufactured by Hitachi Technology) at −100° C. or lower to construct a sample for observation. The resulting sample is observed by TEM with a magnification of about 5,000.

Since the brightness pigment is different from a binder resin in composition and has a characteristic flat shape, it is easy to distinguish due to a difference in the light and shade or shape of the observed image. The brightness pigment is present in the shape of a bar in the internal cross section of the toner and has a different contrast from the other portions.

After the cross sections of 5,000 toner particles are observed, the proportion of toner particles not including the brightness pigment with respect to the total number of all toner particles is calculated.

In the present exemplary embodiment, the proportion of toner particles not including the brightness pigment with respect to the total number of all toner particles is from 5% by number to 80% by number, preferably from 10% by number to 50% by number, more preferably from 15% by number to 40% by number.

In a case where the proportion of toner particles not including the brightness pigment with respect to the total number of all toner particles is less than 5% by number, a number of images having a low printing area printed, particularly, under a high temperature of about 32° C. and a high humidity of about 80% RH may suffer from deterioration of glitter.

In a case where the proportion of toner particles not including the brightness pigment with respect to the total number of all toner particles exceeds 80% by number, the brightness pigment may be insufficiently coated with the binder resin, causing a large difference in electrostatic properties between the toner including the brightness pigment and the toner not including the brightness pigment. In this case, a problem of selective development may be caused or glitter of images may be deteriorated due to a low concentration of the brightness pigment.

In the present exemplary embodiment, the term "glitter" refers to brilliance, such as metallic gloss, of an image formed by using the brightness toner of the present exemplary embodiment when the image is visually recognized.

It is preferred that the ratio of reflectance A at an acceptance angle of +30° to reflectance B at an acceptance angle of −30° (A/B) is from 2 to 100, the reflectance A and reflectance B being measured when light is irradiated at an incidence angle of −45° onto a solid image formed using the brightness toner of the present exemplary embodiment by using a goniophotometer.

The ratio A/B of 2 or more indicates that light is more reflected in a direction (the angle is designated by +) opposite to the incident direction than toward the incident direction (the angle is designated by −), that is, diffuse reflection of the incident light is suppressed. In the case of diffuse reflection where incident light is reflected in many directions, the reflected light appears dark in color visually. In the case of a ratio A/B of 2 or more, when the reflected light is visually recognized, gloss is observed, which implies good glitter. Meanwhile, when the ratio A/B is 100 or less, a viewing angle at which reflected light can be visually recognized is not excessively narrowed, and as a result, the occurrence of a phenomenon of darkness according to angle variation is prevented.

The ratio A/B is more preferably from 20 to 90, particularly preferably from 40 to 80.

Measurement of Ratio A/B Using Goniophotometer

Initially, an explanation will be given regarding the incidence angle and the acceptance angle. In the present exemplary embodiment, the incidence angle is limited to −45° as measured using a goniophotometer. The reason for this limitation is because of high sensitivity of measurement with respect to an image whose degree of gloss is in a wide range.

The acceptance angles are limited to −30° and +30°. The reason for this limitation is because the sensitivity of measurement is highest at acceptance angles of −30° and +30° in evaluating an image having a feeling of glitter and an image having no feeling of glitter.

Subsequently, an explanation will be given regarding a method for the measurement of the ratio A/B.

For the measurement of the ratio A/B in the present exemplary embodiment, first, "a solid image" is formed by the following method. A developer as a sample is filled in a developing vessel of DocuCentre-III C7600 (manufactured by Fuji Xerox, Co., Ltd.) and a solid image with a toner loading amount of 4.5 g/cm$^2$ is formed on a recording paper (OK Topcoat+paper, manufactured by Oji Paper Co., Ltd.) at a fixing temperature of 190° C. and a fixing pressure of 4.0 kg/cm$^2$. The "solid image" represents an image having a printing rate of 100%.

After a goniospectrophotometer (GC5000L, manufactured by Nippon Denshoku Industries Co., Ltd.) is used to allow light to be incident at an angle of −45° on an image portion of the solid image, reflectance A and reflectance B are measured at acceptance angles of +30° and −30°, respectively. Reflectance A and reflectance B are obtained by measuring reflectance values of light in the wavelength range of 400 nm to 700 nm at intervals of 20 nm and averaging the reflectance values measured at the respective wavelengths. From these measurement results, the ratio A/B is calculated.

<Constitution of Toner>

It is preferred that the brightness toner of the present exemplary embodiment satisfies the following requirements (1) and (2) from the viewpoint of satisfying the ratio A/B.

(1) The average equivalent circle diameter D of the toner particle is larger than the average maximum thickness C thereof.

(2) When the cross section of the toner particles is observed in the thickness direction, the proportion of pigment particles whose long-axis direction forms an angle in the range of −30° to +30° relative to the long-axis direction of the cross section of the toner particles with respect to the total number of the pigment particles is 60% or greater.

FIG. 1 is a cross-sectional view schematically illustrating an example of a toner particle that satisfies the above requirements (1) and (2). The schematic view of FIG. 1 is a cross-sectional view in the thickness direction of the toner particle.

The toner particle 2 illustrated in FIG. 1 is flat in shape, has an equivalent circle diameter larger than the thickness L, and contains pigment particles 4.

As illustrated in FIG. 1, so long as the toner particles 2 have a larger equivalent circle diameter than the thickness L, the toner particles tend to move such that the charges of the toner particles are balanced as much as possible when the toner particles are moved to an image carrier, an intermediate transfer member, a recording medium or the like during a development or transfer process for image formation. For this reason, the toner particles are thought to be arranged such that the area attached is maximized. That is, in a recording medium where the toner particles are finally transferred, the flat-shaped toner particles are thought to be arranged such that the flat sides face the surface of the recording medium. Also in a fixing process for image formation, the flat-shaped toner particles are thought to be arranged by a fixing pressure such that the flat sides face the surface of the recording medium.

For this reason, pigment particles satisfying the requirement (2) "the long-axis direction forms an angle in the range of −30° to +30° relative to the long-axis direction of the cross section of the toner particles" among the scale-like pigment particles present in the toner particles are thought to be arranged such that the sides having the largest area face the surface of the recording medium. When light is irradiated onto an image formed using the toner, the proportion of pigment particles diffuse-reflecting the incident light is suppressed. Therefore, it is thought to satisfy the ratio A/B.

Subsequently, an explanation will be given regarding the composition of the brightness toner of the present exemplary embodiment.

—Coloring Agent—

The brightness toner of present exemplary embodiment uses a brightness coloring agent. Examples of brightness coloring agents (brightness pigments) suitable for use in the brightness toner include metal powders, such as aluminum, brass, bronze, nickel, stainless steel and zinc powders; coated foil-like inorganic crystalline substrates, such as mica, barium sulfate, layered silicate and layered aluminum silicate coated with titanium oxide or yellow iron oxide; single-crystal planar titanium oxide; basic carbonates; acid bismuth oxychloride; natural guanine; foil-like glass powder; and metal-deposited foil-like glass powder.

The content of the coloring agent in the brightness toner of the present exemplary embodiment is preferably from 1 part by mass to 70 parts by mass, more preferably 5 parts by mass to 50 parts by mass, based on 100 parts by mass of the toner.

—Binder Resin—

The brightness toner of present exemplary embodiment uses a binder resin. Examples of binder resins suitable for use in the present exemplary embodiment include ethylene resins, such as polyethylene and polypropylene; styrene resins, such as polystyrene and α-polymethylstyrene; (meth)acrylic resins, such as polymethyl methacrylate, polyalkylacrylate and polyacrylonitrile; polyamide resins; polycarbonate resins; polyether resins; polyester; and copolymer resins thereof. Of these, the use of polyester resins is preferred.

A polyester resin is particularly preferred as the binder resin and an explanation will be given below.

The polyester resin is mainly obtained, for example, by polycondensation of a polyhydric carboxylic acid and a polyhydric alcohol.

Examples of such polyhydric carboxylic acids include aromatic carboxylic acids, such as terephthalic acid, isophthalic acid, anhydrous phthalic acid, anhydrous trimellitic acid, anhydrous pyromellitic acid and naphthalenedicarboxylic acid; aliphatic carboxylic acids, such as anhydrous maleic acid, fumaric acid, succinic acid, anhydrous alkenylsuccinic acids and adipic acid; and alicyclic carboxylic acids, such as cyclohexanedicarboxylic acid. These polyhydric carboxylic acids may be used either alone or as a mixture of two or more thereof.

Of these polyhydric carboxylic acids, aromatic carboxylic acids are preferably used. A crosslinked or branched structure of the polyester resin is needed for better fixability. To this end, combinations of dicarboxylic acids and tri- or higher polyhydric carboxylic acids (trimellitic acid or an acid anhydride thereof) are preferred.

Examples of such polyhydric alcohols include aliphatic diols, such as ethylene glycol, diethylene glycol, triethylene glycol, propylene glycol, butanediol, hexanediol, neopentyl glycol and glycerin; and alicyclic diols, such as cyclohexanediol, cyclohexanedimethanol and hydrogenated bisphenol A; and aromatic diols, such as ethylene oxide adducts of bisphenol A and propylene oxide adducts of bisphenol A. These polyhydric alcohols may be used either alone or as a mixture of two or more thereof.

Of these polyhydric alcohols, aromatic diols and alicyclic diols are preferred, and aromatic diols are more preferred. A crosslinked or branched structure of the polyester resin is preferred for better fixability. To this end, combinations of diols and tri- or higher polyhydric alcohols (glycerin, trimethylolpropane and pentaerythritol) may be used.

The brightness toner of the present exemplary embodiment preferably contains a crystalline polyester resin as the binder resin. Since general crystalline aromatic resins have a higher melting temperature than the melting temperature range described below, a crystalline aliphatic polyester resin is preferred as the crystalline polyester resin.

The content of the crystalline polyester resin in the brightness toner of the present exemplary embodiment is preferably from 2% by mass to 30% by mass, more preferably from 4% by mass to 25% by mass.

The melting temperature of the crystalline polyester resin is preferably in the range of 50° C. to 100° C., more preferably 55° C. to 95° C., even more preferably 60° C. to 90° C.

The "crystalline polyester resin" used in the present exemplary embodiment is a compound not showing a stepwise change in endothermic quantity but a clear endothermic peak, as measured by differential scanning calorimetry (hereinafter, also abbreviated as simply "DSC"). A copolymer in which another component is copolymerized with the main chain of a crystalline polyester resin is also referred to as a crystalline polyester so long as the component is present in an amount of 50% by mass or less.

The crystalline polyester resin is synthesized from an acid (dicarboxylic acid) component and an alcohol (diol) component. In the following description, the term "acid-derived constituent component" represents a constituent moiety that is an acid component before synthesis of the polyester resin, and the term "alcohol-derived constituent component" represents a constituent moiety that is an alcohol component before synthesis of the polyester resin.

[Acid-Derived Constituent Component]

Various dicarboxylic acids may be used as acids for the acid-derived constituent component. In the present exemplary embodiment, the acid-derived constituent component for the crystalline polyester resin is preferably a straight-chain aliphatic dicarboxylic acid.

Examples of such aliphatic dicarboxylic acids include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid. Lower alkyl esters and acid anhydrides of these aliphatic dicarboxylic acids may also be exemplified. Adipic acid, sebacic acid and 1,10-decanedicarboxylic acid are preferred.

The polyester resin in the present exemplary embodiment may contain a dicarboxylic acid-derived constituent component having a double bond or a sulfonic acid group.

Examples of such dicarboxylic acids having a sulfonic acid group include, but are not limited to, sodium 2-sulfoterephthalate, sodium 5-sulfoisophthalate and sodium sulfosuccinate. Lower alkyl esters and acid anhydrides of these dicarboxylic acids may also be exemplified. Of these, sodium 5-sulfoisophthalate is preferred.

The content of the acid-derived constituent components (the dicarboxylic acid-derived constituent component having a double bond and the dicarboxylic acid-derived constituent component having a sulfonic acid group) other than the aliphatic dicarboxylic acid-derived constituent components is preferably from 1 constituent mol % to 20 constituent mol %, more preferably from 2 constituent mol % to 10 constituent mol %, based on the total amount of all acid-derived constituent components.

The term "constituent mol %" used herein refers to a percentage by mol of the corresponding acid-derived constituent component, based on the total amount of all acid-derived constituent components, or a percentage by mol of the corresponding alcohol-derived constituent component, based on the total amount of all alcohol-derived constituent components.

[Alcohol-Derived Constituent Component]

An aliphatic diol is preferred as an alcohol for the alcohol-derived constituent component, and examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Of these, ethylene glycol, 1,4-butanediol and 1,6-hexanediol are preferred.

In the present exemplary embodiment, the molecular weight of the polyester resin is measured by gel permeation chromatography (GPC). Specifically, the GPC measurement is carried out on HLC-8120 (manufactured by Tosoh Co., Ltd.) equipped with TSKgel SuperHM-M (15 cm) (manufactured by Tosoh Co., Ltd.) as a column and using THF as a solvent. Subsequently, the molecular weight of the polyester resin is calculated from the measured value using a molecular weight calibration curve plotted on the basis of a monodisperse polystyrene standard sample.

(Method for Producing Polyester Resin)

The method for producing the polyester resin is not particularly limited. The polyester resin may be produced by a general polymerization method, for example, by reacting an acid component with an alcohol component. The polyester resin may be produced by a direct polycondensation or transesterification method. The production method may be appropriately selected depending on the kinds of the monomers. The molar ratio of the acid component to the alcohol component (acid component/alcohol component) varies depending on the reaction conditions, etc. The molar ratio is typically preferably about 1/1, but is not necessarily limited thereto.

A catalyst may be used in the production of the polyester resin. Examples of such catalysts include alkali metal compounds, such as sodium and lithium compounds; alkaline earth metal compounds, such as magnesium and calcium compounds; metal compounds, such as zinc, manganese, antimony, titanium, tin, zirconium and germanium compounds; phosphorous acid compounds; phosphoric acid compounds; and amine compounds.

—Release Agent—

The brightness toner of the present exemplary embodiment may optionally further contain a releasing agent. Examples of such release agents include paraffin waxes, such as low-molecular weight polyethylene and low-molecular weight polypropylene; silicone resins; rosins; rice wax; and carnauba wax. The melting temperatures of these release agents are preferably from 50° C. to 100° C., more preferably from 60° C. to 95° C.

The content of the release agent in the toner is preferably from 0.5% by mass to 15% by mass, more preferably from 1.0% by mass to 12% by mass.

—Other Additives—

In addition to the above-described components, various kinds of components may be optionally further added to the brightness toner of the present exemplary embodiment. These optional components may be internal additives, charge controlling agents, inorganic powders (inorganic particles), and organic particles.

Examples of such charge controlling agents include, but are not particularly limited to, quaternary ammonium salt compounds, nigrosine-based compounds, and dyes composed of metal complexes, such as aluminum, iron and chromium complexes, and triphenylmethane-based pigments.

The inorganic particles may be those known in the art, and examples thereof include silica particles, titanium oxide particles, alumina particles and cerium oxide particles, whose surfaces may be hydrophobically treated. These inorganic particles may be used either alone or in combination of two or more thereof. Particularly preferred are silica particles whose refractive index is smaller than that of the binder resin. As the inorganic particles, there may be used silica particles whose surface is treated, for example, with a silane coupling agent, a titanium coupling agent or a silicone oil.

—Characteristics of Toner—

Average Maximum Thickness C and Average Equivalent Circle Diameter D

As described in (1), it is preferred that the average equivalent circle diameter D of the brightness toner of the present exemplary embodiment is larger than the average maximum thickness C thereof. The ratio of the average maximum thickness C to the average equivalent circle diameter D (C/D) is more preferably in the range of 0.001 to 0.500, even more preferably 0.010 to 0.200, particularly preferably 0.050 to 0.100.

When the ratio C/D is 0.001 or greater, the toner has a strength sufficient to inhibit breakage by stress upon image formation. The high strength of the toner suppresses deterioration of electrostatic properties arising when the pigment is exposed and fading resulting therefrom. Meanwhile, when the ratio C/D is 0.500 or less, good glitter can be obtained.

The average maximum thickness C and the average equivalent circle diameter D are measured by the following methods.

The toner particles are loaded on a smooth surface and are dispersed by applying vibration thereto so as to leave no uneven distribution. From a high magnification image (1,000×) of 1,000 toner particles using a color laser microscope (VK-9700, manufactured by Keyence Corporation), the maximum thickness C and the equivalent circle diameter D are measured as viewed from the top, and arithmetic means thereof are calculated.

Angle between Long-Axis Direction of Toner Particles in Cross Section and Long-Axis Direction of Pigment Particles As mentioned in (2), it is preferred that when the cross section of the toner particles is observed in the thickness direction, the proportion of pigment particles whose long-axis direction forms an angle in the range of −30° to +30° relative to the long-axis direction of the cross section of the toner particles with respect to the total number of the pigment particles is 60% or greater. The proportion is more preferably from 70% to 95%, particularly preferably from 80% to 90%.

When the proportion is 60% or greater, good glitter can be obtained.

Now, an explanation will be given regarding a method for observing the cross section of the toner particles. A sample for observation is prepared in the same manner as in the case where the proportion of toner particles not including the brightness pigment with respect to the total number of all toner particles is calculated.

The cross section of the toner particles in the sample for observation obtained by the above-described method is observed using a transmission electron microscope (TEM) at a magnification of 5,000. The number of pigment particles whose long-axis direction forms an angle in the range of −30° to +30° relative to the long-axis direction of the cross section of the toner particles is counted using an image analysis software, and the ratio is calculated.

Meanwhile, the "long-axis direction of the cross section of the toner particles" represents the direction orthogonal to the thickness direction of the toner particles whose average equivalent circle diameter D is greater than the average maximum thickness C thereof, and the "long-axis direction of the pigment particles" represents the lengthwise direction of the pigment particles.

The volume average particle diameter of the brightness toner of the present exemplary embodiment is preferably from 1 μm to 30 μm, more preferably from 3 μm to 20 μm, even more preferably from 5 μm to 10 μm.

The volume average particle diameter $D_{50}$ is determined as follows.

After particle size ranges (channels) are divided based on a particle size distribution measured using Multisizer II (manufactured by Coulter Co., Ltd.), cumulative distributions of volume and number from the smaller diameter are plotted relative to the particle size ranges. The particle diameters where the cumulative distributions of volume and number reach 16% are defined as $D_{16v}$ and $D_{16p}$, respectively. The particle diameters where the cumulative distributions of volume and number reach 50% are defined as $D_{50v}$ and $D_{50p}$, respectively. The particle diameters where the cumulative distributions of volume and number reach 84% are defined as $D_{84v}$ and $D_{84p}$, respectively. The $D_{50v}$ is defined as the volume average particle diameter $D_{50}$.

<Method for Producing Toner>

The brightness toner of the present exemplary embodiment may be produced by any known method, such as a wet or dry method. A wet method is particularly preferred. Examples of methods suitable for production of the toner include melting suspension, emulsification aggregation and dissolution suspension. Emulsification aggregation is preferred.

According to emulsification aggregation, the constituent materials of the toner are dispersed in aqueous dispersions to prepare respective dispersions, such as a dispersion of the resin particles (emulsification process). Subsequently, the dispersion of the resin particles is mixed, if necessary, with the other dispersions (e.g., a dispersion of the coloring agent or a dispersion of the release agent) to prepare a dispersion of the raw materials.

Subsequently, the dispersion of the raw materials is subjected to aggregation and coalescence processes to obtain toner particles. Aggregated particles are obtained by the aggregation process and are allowed to coalesce by the coalescence process. When it is intended to produce a so-called core-shell structured toner having core particles and shell layers coated on the core particles, the dispersion of resin particles is added to the dispersion of the raw materials after the aggregation process (which becomes core particles after completion of the toner production), the resin particles are attached to the surfaces of the aggregated particles to form coating layers (which becomes shell layers after completion of the toner production), and the coalescence process is carried out. The resin component used in the process for the formation of the coating layers may be the same as or different from the resin component constituting the core particles.

Hereinafter, the individual processes will be explained in detail.

—Emulsification Process—

In the emulsification process for preparing the dispersion of the raw materials, which is used in the formation of aggregated particles, the emulsified dispersion in which the main constituent materials of the toner are dispersed in an aqueous medium is adjusted. Hereinafter, an explanation will be given regarding the dispersion of the resin particles, the dispersion of the coloring agent, the dispersion of the release agent, and the like.

—Dispersion of Resin Particles—

The resin particles dispersed in the dispersion of the resin particles may have a volume average particle diameter of 0.01 μm to 1 μm, 0.03 μm to 0.8 μm, or 0.03 μm to 0.6 μm.

If the volume average particle diameter of the resin particles is greater than 1 μm, the particle diameter distribution of the final toner may be broad or free particles may be formed, tending to cause deterioration of performance or reliability. Meanwhile, when the volume average particle diameter is within the range defined above, the above drawbacks are not encountered and the composition localization of the toner particles is decreased to ensure good dispersion in the toner particles, resulting in little fluctuation in performance or reliability.

The volume average particle diameters of the resin particles and the other particles included in the dispersion of the raw materials are measured using a laser diffraction particle size distribution analyzer (LA-700, manufactured by Horiba, Ltd.).

Aqueous media may be used for the dispersion of the resin particles or the other dispersions.

Examples of the aqueous media include water, such as distilled water and ion-exchanged water, and alcohols. These aqueous media may be used either alone or in combination of two or more thereof. In the present exemplary embodiment, a surfactant may be previously added to and mixed with the aqueous media.

The surfactant is not particularly limited, and examples thereof include anionic surfactants, such as sulfuric ester salts, sulfonates, phosphoric esters and soap surfactants; cationic surfactants, such as amine salts and quaternary ammonium salts; and nonionic surfactants, such as polyethylene glycol, alkylphenol ethylene oxide adducts and polyhydric alcohols. Of these, ionic surfactants, such as anionic surfactants and cationic surfactants, are more preferred. The nonionic surfactants may be combined with anionic surfactants or cationic surfactants. These surfactants may be used either alone or in combination of two or more thereof.

Specific examples of the anionic surfactants include sodium dodecylbenzene sulfonate, sodium dodecyl sulfate, sodium alkylnaphthalene sulfonates, and sodium dialkylsulfosuccinates. Specific examples of the cationic surfactants include alkylbenzenedimethylammonium chlorides, alkyltrimethylammonium chlorides and distearylammonium chloride.

The polyester resin is water self-dispersible due to the presence of functional groups capable of being converted into anionic groups by neutralization. The polyester resin forms a stable aqueous dispersion in an aqueous medium in which a part or all of the functional groups that may become hydrophilic are neutralized with a base.

The functional groups of the polyester resin that may become hydrophilic groups by neutralization are acid groups, such as carboxyl groups or sulfonic acid groups. Examples of neutralizing agents that can neutralize the acid groups include inorganic bases, such as potassium hydroxide and sodium hydroxide; and amines, such as ammonia, monomethylamine, dimethylamine, trimethylamine, monoethylamine, diethylamine, triethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine and N,N-dimethylpropanolamine. These neutralizing agents may be used either alone or as a mixture of two or more thereof. By the addition of these neutralizing agents, the pH of the dispersion of the polyester resin is adjusted to neutral during emulsification to prevent hydrolysis of the dispersion of the polyester resin.

The dispersion of the resin particles may be adjusted by phase inversion emulsification using a polyester resin. Alternatively, the dispersion of the resin particles may be adjusted by phase inversion emulsification using a binder resin other than a polyester resin. Phase inversion emulsification is a process in which a resin is dissolved in a hydrophobic organic solvent capable of dissolving the resin, a base is added to the organic continuous phase (0 phase) to neutralize the resin, an aqueous medium (W phase) is added to invert the resin into a discontinuous phase from W/O to O/W (so-called phase inversion), so that the resin can be dispersed and stabilized in the form of particles in the aqueous medium.

Examples of organic solvents usable for the phase inversion emulsification include alcohols, such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones, such as methyl ethyl ketone, methyl isobutyl ketone, ethyl butyl ketone, cyclohexanone and isophorone; ethers, such as tetrahydrofuran, dimethyl ether, diethyl ether and dioxane; esters, such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate and dimethyl carbonate; and glycol derivatives, such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate and dipropylene glycol monobutyl ether. Other examples include 3-methoxy-3-methylbutanol, 3-methoxybutanol, acetonitrile, dimethylformamide, dimethylacetamide, diacetone alcohol and ethyl acetoacetate. These solvents may be used either alone or in combination of two or more thereof.

It is difficult to commonly determine the amount of the organic solvent used for the phase inversion emulsification because the amount of the organic solvent to obtain a desired dispersion particle diameter varies depending on the physical properties of the resin. In the present exemplary embodiment, the organic solvent may be used in a relatively large amount relative to the weight of the resin, for example, if the content of a tin compound as a catalyst in the resin is high compared to that in a common polyester resin. A small amount of the solvent may cause insufficient emulsifiability of the resin, leading to a large size diameter or a broad particle size distribution of the resin particles.

A dispersant may be added during the phase inversion emulsification to stabilize the dispersed particles or prevent the thickening of the aqueous medium. Examples of such dispersants include water soluble polymers, such as polyvinyl alcohol, methyl cellulose, ethyl cellulose, hydroxyethyl cellulose, carboxymethyl cellulose, sodium polyacrylate and sodium polymethacrylate; anionic surfactants, such as sodium dodecylbenzenesulfonate, sodium octadecyl sulfate, sodium oleate, sodium laurate and potassium stearate; cationic surfactants, such as laurylamine acetate, stearylamine acetate and lauryltrimethylammonium chloride; amphoteric surfactants, lauryldimethylamine oxide; nonionic surfactants, such as polyoxyethylene alkyl ethers, polyoxyethylene alkyl phenyl ethers and polyoxyethylene alkyl amines; and inorganic compounds, such as tricalcium phosphate, aluminum hydroxide, calcium sulfate, calcium carbonate and barium carbonate. These dispersants may be used either alone or in combination of two or more thereof. The dispersant may be added in an amount of 0.01 parts by mass to 20 parts by mass, based on 100 parts by mass of the binder resin.

The emulsification temperature upon phase inversion emulsification may be equal to or lower than the boiling temperature of the organic solvent or may be equal to or higher than the melting temperature or glass transition temperature of the binder resin. If the emulsification temperature is lower than the melting temperature or glass transition temperature of the binder resin, it is difficult to adjust the dispersion of the resin particles. Meanwhile, it is desirable to emulsify the dispersion of the resin particles at a temperature equal to or higher than the boiling temperature of the organic solvent in a closed apparatus under pressure.

The content of the resin particles in the dispersion of the resin particles may be typically from 5% by mass to 50% by mass or from 10% by mass to 40% by mass. Outside this range, the particle size distribution of the resin particles may be broad, resulting in worsening of characteristics.

—Dispersion of Coloring Agent—

The dispersion of the coloring agent may be adjusted by a general dispersion method, for example, by using a rotary shear type homogenizer, or a ball mill, a sand mill or a Dynomill having media. However, no limitation is imposed on the dispersion method. If needed, an aqueous dispersion of the coloring agent may be prepared using a surfactant, or a dispersion of the coloring agent in an organic solvent may be prepared using a dispersant. Each of the surfactant and the dispersant used for the dispersion may be of the same kind as the dispersant that can be used to disperse the binder resin.

When the dispersion of the raw materials is prepared, the dispersion of the coloring agent may be mixed with the dispersions of the other particles all at one time or may be added to and mixed with them in divided portions.

The content of the coloring agent in the dispersion of the coloring agent may be typically from 5% by mass to 50% by mass or 10% by mass to 40% by mass. Outside this range, the particle size distribution of the coloring agent particles may be broad, resulting in worsening of characteristics.

—Dispersion of Release Agent—

The dispersion of the release agent is prepared by dispersing the release agent, together with an ionic surfactant, in water, heating the dispersion to a temperature equal to or higher than the melting temperature of the release agent, and applying a high shear force to the hot dispersion using a homogenizer or a pressure-discharge type disperser. As a result, the volume average particle diameter of the releasing agent particles is adjusted to 1 μm or smaller. A dispersion medium of the dispersion of the release agent may be of the same kind as the dispersion medium used in the binder resin.

Known emulsion•dispersion apparatuses may be used to mix the binder resin, the coloring agent, etc. in the dispersion medium, and examples thereof include continuous emulsification•dispersion apparatuses, such as Homomixer (manufactured by Tokushu Kika Kogyo Co., Ltd.), Slasher (manufactured by Mitsui Mining Co., Ltd.), Cavitron (manufactured by Eurotec, Ltd.), Micro-fluidizer (manufactured by Mizuho Industrial Co., Ltd.), Manton-Gorin Homogenizer (manufactured by Gorin Company), Nanomizer (manufactured by Nanomizer Co., Ltd.) and Static Mixer (manufactured by Noritake Company).

One or more components selected from release agents, internal additives, charge controlling agents and organic powders, which are already described, may be previously dispersed in the dispersion of the binder resin according to the intended purpose.

A dispersion of a component other than the binder resin, the coloring agent and the release agent may be adjusted. In this case, the volume average particle diameter of particles dispersed in the dispersion may be typically not larger than 1

μm or from 0.01 μm to 0.5 μm. In a case where the volume average particle diameter is larger than 1 μm, the particle diameter distribution of the final toner may be broad or free particles may be formed, tending to cause deterioration of performance or reliability. Meanwhile, in a case where the volume average particle diameter is within the range defined above, the above drawbacks are not encountered and the composition localization of the toner particles is decreased to ensure good dispersion in the toner particles, resulting in little fluctuation in performance or reliability.

—Process for Forming Aggregated Particles—

In the process for forming aggregated particles (a process for preparing a dispersion of the aggregated particles), the dispersion of the raw materials is obtained by mixing the dispersion of the resin particles, optionally together with the dispersion of the coloring agent, the dispersion of the release agent and the other dispersions. An aggregation agent is further added to the dispersion of the raw materials, followed by heating to form aggregated particles. In the case where the resin particles are crystalline resin particles, such as crystalline polyester resin particles, the heating is performed at a temperature (±20° C.) around or not higher than the melting temperature of the binder resin to form aggregated particles.

The formation of the aggregated particles is effected by the addition of an aggregation agent with stirring using a rotary shear type homogenizer at room temperature to make the pH of the dispersion of the raw materials acidic. At this time, there is a need to inhibit the particles from rapid aggregation by heating. To this end, the pH of the dispersion may be adjusted during mixing with stirring at room temperature, and if needed, a dispersion stabilizer may be added to the dispersion.

In the present exemplary embodiment, "room temperature" refers to 25° C.

The aggregation agent used for the process for the formation of aggregated particles is preferably a surfactant having a polarity opposite to the polarity of the surfactant used as the dispersant, i.e. a di- or higher valent metal complex as well as an inorganic metal salt, added to the dispersion of the raw materials. In particular, a metal complex is particularly preferred as the surfactant because the amount of the surfactant used can be reduced, which results in improvement of charging properties.

If necessary, an additive capable of forming a complex or a similar bond with a metal ion may be used. A chelating agent is suitable as the additive.

Examples of such inorganic metal salts include metal salts, such as calcium chloride, calcium nitrate, barium chloride, magnesium chloride, zinc chloride, aluminum chloride and aluminum sulfate; and polymers of inorganic metal salts, such as polyaluminum chloride, polyaluminum hydroxide and calcium polysulfide. Of these, aluminum salts and polymers thereof are particularly suitable. A higher valency of the inorganic metal salt, i.e. tetravalent>trivalent>divalent>monovalent, is more suitable to obtain a sharper particle diameter distribution. In the case of the same valency, a polymeric inorganic metal salt is more suitable than a monomeric inorganic metal salt.

The chelating agent may be a water soluble one. A water insoluble chelating agent is undesirable because it is not readily dispersible in the dispersion of the raw materials and cannot sufficiently capture a metal ion generated from the coagulant in the toner.

There is no particular restriction on the kind of the chelating agent. Any known chelating agent may be used and examples thereof include oxycarboxylic acids, such as tartaric acid, citric acid and gluconic acid, iminodiacetic acid (IDA), nitrilotriacetic acid (NTA), and ethylenediaminetetraacetic acid (EDTA).

The amount of the chelating agent added may be in the range of 0.01 parts by mass to 5.0 parts by mass or from 0.1 parts by mass to less than 3.0 parts by mass, based on 100 parts by mass of the binder resin. If the chelating agent is added in an amount of less than 0.01 parts by mass, the effect of adding the chelating agent may not be exhibited. Meanwhile, the addition of the chelating agent in an amount exceeding 5.0 parts by mass may affect the electrostatic properties of the toner and causes a dramatic change in the viscoelasticity of the toner, which imparts a bad influence on the low-temperature fixability or image gloss.

The chelating agent may be added before, during or after the process for forming aggregated particles or a subsequent process for forming coating layers. Upon addition of the chelating agent, it is not necessary to adjust the temperature of the dispersion of the raw materials. That is, the chelating agent may be added at room temperature without temperature adjustment and may be added. Alternatively, before addition, the temperature of the chelating agent may be adjusted to the internal temperature of a vessel for the process for forming aggregated particles or a subsequent process for forming coating layers.

—Process for Forming Coating Layers—

If necessary, a process for forming coating layers may be carried out after the process for forming aggregated particles. In the process for forming coating layers, resin particles are attached to the surfaces of aggregated particles formed after the process for forming aggregated particles to form coating layers. As a result, a core-shell structured toner can be obtained.

The coating layers are usually formed by further adding a dispersion of resin particles to the dispersion of the raw materials in which aggregated particles (core particles) are formed in the process for forming aggregated particles.

A coalescence process is carried out after the process for forming coating layers.

The process for forming coating layers and the coalescence process may be carried out alternately to form multiple divided coating layers.

—Coalescence Process—

The coalescence process is carried out after the process for forming aggregated particles or after the process for forming aggregated particles and the process for forming coating layers. In the coalescence process, the pH of a suspension including the aggregated particles formed after the previous process (es) is adjusted to the range of 6.5 to 8.5 to stop further aggregation of the aggregated particles.

After the aggregation is stopped, heating is performed to allow the aggregated particles to coalesce. The aggregated particles may coalesce by heating to a temperature equal to or higher than the melting temperature of the binder resin.

—Washing, Drying, Etc.—

After completion of the coalescence process, washing, solid-liquid separation and drying processes are carried out to obtain desired toner particles. The washing process is preferably performed by removing the dispersant attached on the toner particles using an aqueous solution of a strong acid, such as hydrochloric acid, sulfuric acid or nitric acid, and washing the toner particles with ion-exchanged water, etc. until the filtrate becomes neutral. The solid-liquid separation process is not particularly limited but is carried out by a suitable process, such as filtration under suction or pressure, which is preferred in terms of productivity. The drying process is not particularly limited but is carried out by a suitable process, such as freeze-drying, flash jet drying, fluidized drying or vibration fluidized drying, which is preferred in terms of productivity.

After the drying process, the amount of water in the toner particles may be adjusted to 1.0% by mass or less or 0.5% by mass or less.

Various external additives described above may be added, if needed, to the toner particles after drying.

It is preferred that the toner of the present exemplary embodiment satisfies the requirements of (1) and (2), as described above. The toner may be produced by emulsification aggregation, for example in accordance with the following method.

Initially, pigment particles are prepared. The pigment particles and binder resin are mixed and dispersed and dissolved in a solvent. The solution is dispersed in water by phase inversion emulsification or phase inversion emulsification to produce brightness pigment coated with the resin. To the brightness pigment particles are added other components (for example, a release agent and a resin for shell formation) and an aggregation agent. The mixture is heated with stirring to around the glass transition temperature (Tg) of the resin to form aggregated particles. In this process, the mixture is stirred at a high rate (for example, 500 rpm to 1,500 rpm), for example, using a stirring blade provided with two puddles for laminar flow formation. As a result of the stirring, the brightness pigment particles are well ordered toward the long axis and the aggregated particles also aggregate toward the long-axis direction, so that the toner can be reduced in thickness (that is, the toner satisfies the requirement (1)). Finally, the aggregated particles are made alkaline for stabilization and are heated to a temperature equal to or higher than the glass transition temperature (Tg) of the toner but not higher than the melting temperature (Tm) of the toner. As a result, the aggregated particles coalesce. This coalescence process is carried out at a lower temperature (for example, 60° C. to 80° C.) to reduce the movement of the materials resulting from rearrangement thereof, so that the alignment of the pigment is maintained and the toner can satisfy the requirement (2).

The stirring is preferably performed at a rate of 650 rpm to 1,130 rpm, particularly preferably 760 rpm to 870 rpm. The coalescence temperature is preferably from 63° C. to 75° C., particularly preferably from 65° C. to 70° C.

To adjust the proportion of toner particles not including the brightness pigment with respect to the total number of all toner particles to the range from 5% by number to 80% by number, for example, the brightness toners may be produced by a method including the following processes: preparing a first aggregated particle dispersion by mixing a brightness pigment dispersion including a brightness pigment with first binder resin particle dispersion including a first binder resin to prepare the first aggregated particle dispersion including the brightness pigment and the first binder resin; preparing a second aggregated particle dispersion by using a second binder resin dispersion including a second binder resin to prepare the second aggregated particle dispersion including the second binder resin; promoting aggregation by mixing the first aggregated particle dispersion with the second aggregated particle dispersion such that the ratio (by mass) of the first binder resin to the second binder resin is in a range from 3:97 to 49:51 to further promote aggregation of the first aggregated particles and the second aggregated particles; and coalescing the first aggregated particles and the second aggregated particles by heating the mixed dispersion to allow the first aggregated particles and the second aggregated particles to coalesce.

The ratio (by mass) of the first binder resin to the second binder resin is preferably from 6:94 to 30:70, more preferably from 9:91 to 24:76.

In the processes for preparing the first and second aggregated particle dispersions, the kind of the first binder resin may be the same as or different from that of the second binder resin.

A dispersion of an additive, such as a release agent, may be optionally added during the process for preparing the dispersion of first or second aggregated particles.

A process for forming coating layers may be carried out after the aggregation promotion process and before the coalescence process.

Alternatively, the brightness toner of the present exemplary embodiment may be produced by preparing toner particles including a brightness pigment and toner particles not including a brightness pigment and adding the toner particles including a brightness pigment to toner particles not including a brightness pigment in such a ratio such that the proportion of toner particles not including a brightness pigment with respect to the total number of all toner particles is from 5% by number to 80% by number.

—External Additive—

In the present exemplary embodiment, an external additive, such as a fluidizing agent or an aid, may be added to treat the surface of the toner particles. The external additive particles may be known particles, for example, inorganic particles, such as silica particles, titanium oxide particles, alumina particles, cerium oxide particles or carbon black particles, whose surfaces are hydrophobically treated, or polymer particles, such as polycarbonate, polymethyl methacrylate or silicone particles.

<Developer>

The brightness toner of the present exemplary embodiment may be used as single-component developer without further processing. Alternatively, the brightness toner of the present exemplary embodiment may be used as a component of a two-component developer. In this case, the brightness toner of the present exemplary embodiment is used in combination with a carrier.

There is no particular restriction on the kind of the carrier. The carrier may be any of those known in the art. The carrier may be, for example, a magnetic metal, such as iron oxide, nickel or cobalt, a magnetic oxide, such as ferrite or magnetite, a resin-coated carrier having a resin coating layer on the surface of the magnetic metal or the magnetic oxide as a core material, or a magnetic dispersion carrier. The carrier may be a resin dispersion carrier in which a conductive material is dispersed in a matrix resin.

Examples of coating resins and the matrix resins usable in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins consisting of organosiloxane bonds or modified products thereof, fluorinated resins, polyester, polycarbonate, phenolic resins, and epoxy resins.

Examples of the electrically conductive materials include, but are not limited to, metals, such as gold, silver and copper, carbon black, titanium oxide, zinc oxide, barium sulfate, aluminum borate, potassium titanate, and tin oxide.

Examples of suitable core materials of the carrier include magnetic metals, such as iron, nickel and cobalt; magnetic oxides, such as ferrite and magnetite; and glass beads. When the carrier is used in a magnetic brush method, a magnetic material is preferred as the core material. The volume average particle size of the core material of the carrier is generally in the range from 10 μm to 500 μm, preferably from 30 μm to 100 μm.

When it is desired to coat the surface of the core material of the carrier with a resin, a solution of the resin, and optionally, various additives in an appropriate solvent may be coated on the surface of the core material to form a coating layer. The solvent is not particularly limited and may be suitably selected depending on the kind of the resin, applicability, etc.

Specific examples of resin coating methods include a method for dipping the core material of the carrier in a solution for forming a coating layer, a method for spraying a solution for forming a coating layer on the surface of the core material of the carrier, a method for spraying a solution for forming a coating layer in a state which the core material of the carrier is suspended by fluidizing air (a fluidized bed method), and a method for mixing the core material of the carrier with a solution for forming a coating layer in a kneader coater and removing the solvent (a kneader coating method).

In the two-component developer, the mixing ratio (by mass) between the brightness toner of the present exemplary embodiment to the carrier is preferably in the range from 1:100 to 30:100 (toner:carrier), more preferably in the range from 3:100 to 20:100.

<Image Forming Apparatus>

Figure 2:
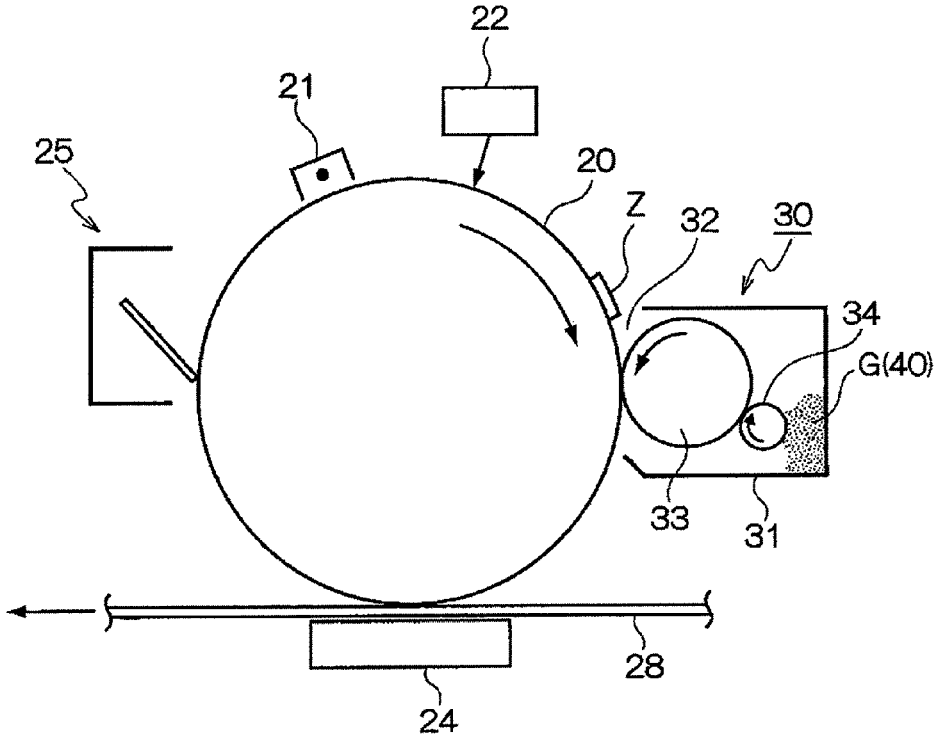
FIG. 2 is a schematic view illustrating the construction of an image forming apparatus of the present exemplary embodiment.

FIG. 2 is a schematic view illustrating the constitution of an image forming apparatus including a developing unit to which the brightness toner of the present exemplary embodiment is applied.

As illustrated in FIG. 2, the image forming apparatus of the present exemplary embodiment includes a photoconductor drum 20 as an image holding member rotating in a predetermined direction, a charging unit 21 disposed around the photoconductor drum 20 to electrically charge the photoconductor drum 20, a unit (e.g., an exposure unit 22) for forming an electrostatic latent image Z on the photoconductor drum 20, a developing unit 30 for visualizing the electrostatic latent image Z formed on the photoconductor drum 20, a transfer unit 24 for transferring the visualized toner image on the photoconductor drum 20 to a recording paper 28 as a transfer-receiving material, and a cleaning unit 25 for cleaning the toner remaining on the photoconductor drum 20, these units being sequentially arranged.

In the present exemplary embodiment, as illustrated in FIG. 2, the developing unit 30 has a developing housing 31 in which a developer G including a toner 40 is accommodated. In the developing housing 31, an opening for development 32 is formed so as to be opposite to the photoconductor drum 20 and a developing roll (a developing electrode) 33 as a toner holding member is installed to face the opening for development 32. A fixed developing bias is applied to the developing roll 33 to form a developing electric field in a developing area defined between the photoconductor drum 20 and the developing roll 33. In the developing housing 31, a charge injecting roll (an injection electrode) 34 is installed opposite to the developing roll 33. Particularly, in the present exemplary embodiment, the charge injecting roll 34 also acts as a roll for supplying the toner 40 to the developing roll 33.

Herein, the charge injecting roll 34 may be rotated in an arbitrarily selected direction, but is preferably rotated in the same direction as that of the developing roll 33 at the contact area taking into consideration the supply properties of the toner and charge injecting properties. It is preferred that the charge injecting roll 34 is rotated with a peripheral velocity difference of 1.5 times or greater to allow the toner 40 to enter the contact area between the charge injecting roll 34 and the developing roll 33 where the toner 40 is rubbed and abraded to inject charges.

Now, an explanation will be given regarding the operation of the image forming apparatus of the present exemplary embodiment.

At the start of the image forming process, first, the surface of the photoconductor drum 20 is electrically charged by the electrically charging unit 21, the exposure unit records the electrostatic latent image Z on the electrically charged photoconductor drum 20, and the development unit 30 visualizes the electrostatic latent image Z as a toner image. Then, the toner image on the photoconductor drum 20 is conveyed to a site to be transferred and is electrostatically transferred to the recording paper 28 as a transfer-receiving media by the transfer unit 24. The toner remaining on the photoconductor drum 20 is cleaned by the cleaning unit 25. Thereafter, the toner image is fixed on the recording paper 28 by a fixing unit (not shown) to obtain an image.

<Process Cartridge and Toner Cartridge>

Figure 3:
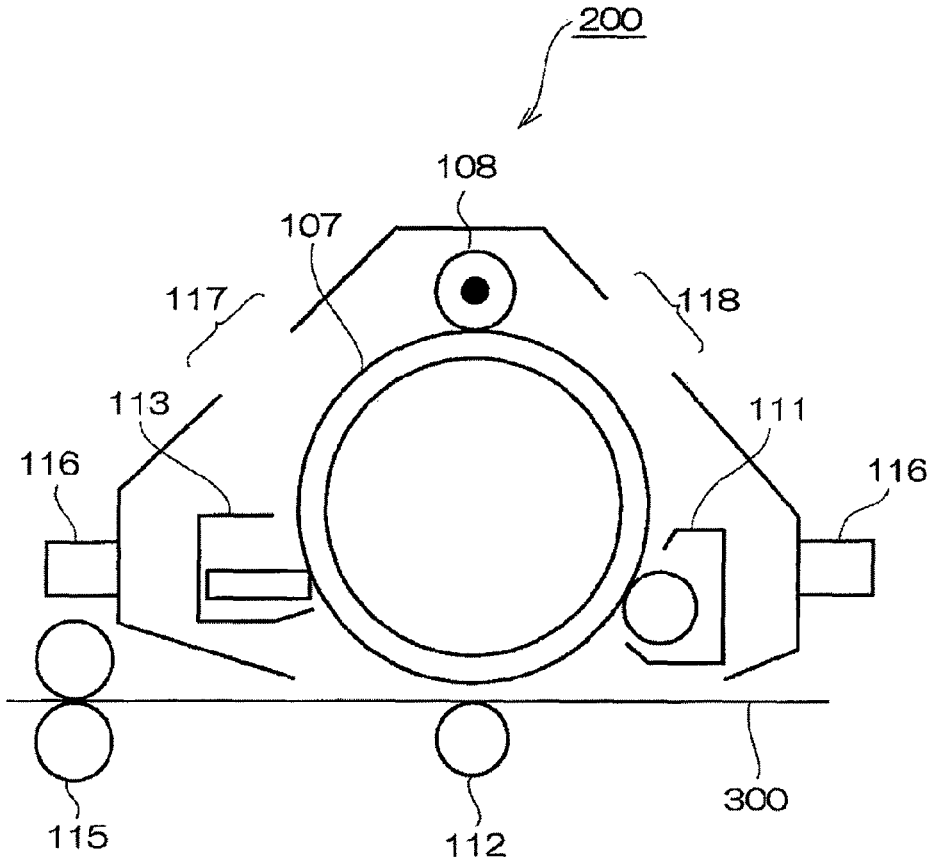
FIG. 3 is a schematic view illustrating the construction of an example of a process cartridge according to the present exemplary embodiment.

FIG. 3 is a schematic view illustrating the constitution of an example of a process cartridge of the present exemplary embodiment. The process cartridge of the present exemplary embodiment is characterized in that it has a toner holding member to accommodate the brightness toner of the exemplary embodiment and convey the toner while holding the toner.

As illustrated in FIG. 3, the process cartridge 200 is a combination of a photoconductor 107, an electrically charging roller 108, a development apparatus 111, a photoconductor cleaning apparatus 113, an opening for exposure 118 and an opening for antistatic exposure 117 on a rail 116, which are integrated into one cartridge. The process cartridge 200 is attached detachably to a transfer apparatus 112, a fixing apparatus 115 and a main body of an image forming apparatus including other elements (not shown).

In FIG. 3, reference numeral 300 indicates a transfer-receiving material.

The photoconductor 107, the electrically charging roller 108, the development apparatus 111, the cleaning unit 113, the opening for exposure 118 and the opening for erasing exposure 117 included in the process cartridge 200 illustrated in FIG. 3 may be selectively combined. For example, the process cartridge of the present exemplary embodiment may include the development apparatus 111 and at least one element selected from the group consisting of the photoconductor 107, the electrically charging roller 108, the cleaning apparatus (cleaning unit) 113, the opening for exposure 118 and the opening for erasing exposure 117.

Next, an explanation will be given concerning a toner cartridge.

The toner cartridge is attached detachably to the image forming apparatus and at least accommodates a toner that is supplied to the developing unit installed in the image forming apparatus. The toner is the brightness toner of the present exemplary embodiment explained already. The construction of the toner cartridge is not limited so long as the toner is accommodated in the toner cartridge. A developer may be accommodated in the toner cartridge depending on the mechanism of the image forming apparatus.

The image forming apparatus illustrated in FIG. 2 is constructed such that a toner cartridge (not shown) is attached detachably. The development unit 30 is connected to the toner cartridges through a toner supply pipe (not shown). The toner cartridge can be exchanged with a new one when the developer accommodated in the toner cartridge is substantially used up.

The present exemplary embodiment will be explained in more detail with reference to the following examples and comparative examples. However, these examples are not intended to limit the present exemplary embodiment. In the examples, unless otherwise indicated, all "parts" and "percentages" are by mass.

Example 1

<Synthesis of Binder Resin>

Bisphenol A ethylene oxide 2 mole adduct: 216 parts

Ethylene glycol: 38 parts

Tetrabutoxytitanate (catalyst): 0.037 parts

A two-neck flask is heated and dried. The above components are put in the flask and a nitrogen gas is introduced into the flask. The mixture is heated with stirring while maintaining an inert atmosphere, followed by copolycondensation at 160° C. for 7 hours. Thereafter, the reaction mixture is heated to 220° C. while slowly reducing the pressure to 10 Torr and is maintained for 4 hours. The pressure is returned to normal pressure. To the reaction mixture is added 9 parts of anhydrous trimellitic acid. The pressure is gradually reduced to 10 Torr and maintained at 220° C. for 1 hour, yielding a binder resin.

<Preparation of Dispersion of Resin Particles>

Binder resin: 160 parts

Ethyl acetate: 233 parts

Aqueous solution of sodium hydroxide (0.3N): 0.1 parts

The above components are put in a separable 1,000 ml flask, heated to 70° C., and stirred using a three-one motor (manufactured by Shinto Scientific Co., Ltd.) to prepare a resin mixture. The resin mixture is further stirred. 373 parts of ion-exchanged water is slowly added to the resin mixture with stirring and is subjected to phase inversion emulsification to remove the solvents, yielding a dispersion of the resin particles (solid content: 30%).

<Preparation of Dispersion of Release Agent>

Carnauba wax (RC-160, TOA Kasei Co., Ltd.): 50 parts

Anionic surfactant (Neogen RK, Dai-ichi Kogyo Seiyaku Co., Ltd.): 1.0 part

Ion-exchanged water: 200 parts

The above components are mixed and heated to 95° C. The mixture is dispersed using a homogenizer (manufactured by ULTRA-TURRAX T50, IKA Co., Ltd.) and is further dispersed using a Manton-Gorin high-pressure homogenizer (manufactured by Gorin Company) for 360 minutes to prepare a dispersion (solid content: 20%) in which the release agent particles having a volume average particle size of 0.23 μm are dispersed.

<Preparation of Dispersion of Coloring Agent>

Aluminum pigment (2173EA, Showa Aluminum Powder K.K.): 100 parts

Anionic surfactant (Neogen RK, Dai-ichi Kogyo Seiyaku Co., Ltd.): 1.5 parts

Ion-exchanged water: 900 parts

After a solvent is removed from a paste of the aluminum pigment, the other components are mixed. The mixture is dispersed for 1 hour using a CAVITRON homogenizer (CR1010, manufactured by Pacific Machinery & Engineering Co., Ltd.) to prepare a dispersion (solid content: 10%) in which the brightness pigment (aluminum pigment) is dispersed.

<Production of Brightness Toner 1>

Dispersion of resin particles (first binder resin particle dispersion): 212.5 parts Dispersion of release agent: 25 parts Dispersion of coloring agent: 100 parts Nonionic surfactant (IGEPAL CA897): 1.40 parts The above components are put in a 2 L cylindrical stainless steel container and mixed for 10 minutes while applying a shear force thereto using a homogenizer (ULTRA-TURRAX T50, manufactured by IKA Co., Ltd.) at 4,000 rpm.

To the mixture is slowly added dropwise 1.75 parts of a 10% aqueous nitric acid solution of polyaluminum chloride as an aggregation argent. The resulting mixture is dispersed and mixed for 15 minutes using the homogenizer at 5,000 rpm to prepare a dispersion of first aggregated particles (process for preparing a first aggregated particle dispersion).

Then, a second aggregated particle dispersion is prepared by using 250 parts of dispersion of resin particles (second binder resin particle dispersion), 25 parts of dispersion of release agent, and 1.40 parts of nonionic surfactant (IGEPAL CA897).

Subsequently, the dispersion of the first aggregated particles and the dispersion of the second aggregated particles are mixed. Then, the mixture of the dispersion of the first aggregated particles and the dispersion of the second aggregated particles is transferred to a polymerization autoclave equipped with a thermometer and an agitator using a stirring blade with two puddles for laminar flow formation, and is heated on a mantle heater with stirring rotation of 810 rpm to promote growth of the aggregated particles at 54° C. (process for promoting aggregation). Further, the dispersion of the raw materials is adjusted to a pH in the range from 2.2 to 3.5 using a 0.3 N nitric acid or a 1 N aqueous solution of sodium hydroxide. The dispersion of the raw materials is maintained in the pH range about 2 hours. The aggregated particles are found to have a volume average particle size of 10.4 μm, as measured using Multisizer II (opening diameter: 50 μm, manufactured by Coulter Co., Ltd.).

Subsequently, 33.3 parts of the dispersion of the resin particles is further added to the dispersion of the raw materials to attach the resin particles of the binder resin to the surfaces of the aggregated particles (process for forming coating layers). After the aggregated particles are allowed to be orderly arranged by heating to 56° C., their size and shape are measured using an optical microscope and a Multisizer II.

Thereafter, the pH is increased to 8.0 and then the temperature is increased to 67.5° C., to allow the aggregated particles to coalesce (process for coalescing). The coalescence of the aggregated particles is observed using an optical microscope. The pH is lowered to 6.0 while maintaining the temperature at 67.5° C. After 1 hour, the heating is stopped, followed by cooling at a rate of 1.0° C./minute. Then, the aggregated particles are sieved with a 40 μm mesh, washed repeatedly, and dried in a vacuum dryer to produce a toner having a volume average particle size of 12.2 μm.

100 parts by mass of the toner, 1.5 parts of hydrophobic silica (RY50, NIPPON AEROSIL Co., Ltd.) and 1.0 part of hydrophobic titanium oxide (T805, NIPPON AEROSIL Co., Ltd.) are mixed and blended using a sample mill at 10,000 rpm for 30 seconds. Then, the mixture is sieved using a vibrating sieve having an opening size of 45 μm to prepare a brightness toner 1.

<Measurement>

"The ratio A/B", "the ratio of the average maximum thickness C of the toner particles to the average equivalent circle diameter D thereof", "the proportion of pigment particles whose long-axis direction forms an angle in the range of −30° to +30° relative to the long-axis direction of the cross section of the toner particles with respect to the total number of the pigment particles when the cross section of the toner particles is observed in the thickness direction (hereinafter, referred to as simply "the proportion of pigments within the range of ±30°")", and "the proportion of toner particles not including a brightness pigment with respect to the total number of all toner particles" are measured by the above-described methods. The results are shown in Table 1.

<Production of Carrier>

Ferrite particles (volume average particle size: 35 μm): 100 parts

Toluene: 14 parts

Perfluorooctylethyl methacrylate-methyl methacrylate copolymer (critical surface tension is 24 dyn/cm, copolymerization ratio is 2:8, weight average molecular weight is 77,000): 1.6 parts Carbon black (Product Name: VXC-72, Cabot Corporation, volume resistance rate≤100 Ωcm): 0.12 parts Crosslinked melamine resin particles (average particle size is 0.3 μm, using no toluene): 0.3 parts First, a dilute solution of the carbon black in the toluene is added to the perfluorooctylethyl methacrylate-methyl methacrylate copolymer. The mixture is dispersed using a sand mill to prepare a first dispersion. The components except the ferrite particles are dispersed for 10 minutes using a stirrer to prepare a second dispersion. The second dispersion is combined with the first dispersion to prepare a solution for coating layer formation. Then, the solution for coating layer formation and the ferrite particles are put in a vacuum deaeration kneader and stirred at 60° C. for 30 minutes. The toluene is partially removed under reduced pressure to form a resin coating layer, completing the production of a carrier.

<Production of Developer>

36 parts of the glitter toner 1 and 414 parts of the carrier are placed in a 2 L V-blender and stirred for 20 minutes. The mixture is sieved (212 μm) to produce a developer 1.

<Evaluation>

Transferability

The transferability of the toner is evaluated using a modified machine of DocuCentre-III C7600 (manufactured by Fuji Xerox Co., Ltd.). The modified machine is designed to be stopped before the toner is transferred so that the amounts of the toner on a photoconductor, on an intermediate transfer member and on a sheet of paper (non-fixed) can be measured. The surface temperature of a fixing roll is set to 130° C.

For transferability evaluation, after patches of 5 cm×5 cm are drawn on 1,000 sheets of C2 paper (Fuji-Xerox Co., Ltd.) at 32° C. and 80% RH, the weight of the toner on each sheet of paper is measured and the primary transfer efficiency and secondary transfer efficiency of the toner are calculated by the following equations. When a union of the primary transfer efficiency and the secondary transfer efficiency of the toner is 80% or more, it is adopted as an allowable level for the toner.

Primary transfer efficiency=(weight of toner on intermediate transfer member)/(weight of toner on photoconductor)

Secondary transfer efficiency=(weight of non-fixed toner on paper)/(weight of toner on intermediate transfer member)

Transferability=(primary transfer efficiency)×(secondary transfer efficiency)×100

Brightness Property

A solid image is formed by the following method.

After the developer as a sample is filled in a developing vessel of DocuCentre-III C7600 (manufactured by Fuji Xerox Co., Ltd), a solid image with a toner loading amount of 4.5 g/cm$^2$ is formed on a recording paper (OK Topcoat+paper, Oji Paper Co., Ltd.) at a fixing temperature of 190° C. and a fixing pressure of 4.0 kg/cm$^2$.

Solid images, each of which has a printing area of 10%, are formed on 10,000 sheets of recording paper at 32° C. and 80% RH. The glitter of the solid images is evaluated by visual observation under lighting (natural lighting) for color observation pursuant to JIS K 5600-4-3:1999 "General testing methods for paints—Part 4: Visual characteristics of coating films—Section 3: Visual comparison of colors". For glitter evaluation, feel of particles (brightness effect) and optical effect (variation in color according to viewing angle) are observed and scored based on the following criteria. 2 or higher is a level for practical use. The results are shown in Table 1.

—Evaluation Criteria—

5: Harmony of feel of particles and optical effect is observed.

4: Feel of particles and optical effect are slightly observed.

3: Average feel is observed.

2: Fading feel is observed.

1: Feel of particles and optical effect are not observed.

Example 2

In Example 2, a toner is produced in the same manner as in Example 1, except that the amounts of the dispersions of first and second binder resin particles according to the production of brightness toner as described in Example 1, are changed to 241.6 parts and 250 parts, respectively. Then, the toner is evaluated in the same manner as in Example 1. The results are shown in Table 1.

Example 3

In Example 3, a toner is produced in the same manner as in Example 1, except that the amounts of the dispersions of first and second binder resin particles according to the production of brightness toner as described in Example 1, are changed to 133.0 parts and 250 parts, respectively. Then, the toner is evaluated in the same manner as in Example 1. The results are shown in Table 1.

Example 4

In Example 4, a toner is produced in the same manner as in Example 1, except that the stirring rotation in the process to promote growth of the aggregated particles described in Example 1 (process for promoting aggregation) is changed from 810 rpm to 520 rpm, and the temperature of the process to coalesce the aggregate particles (process for coalescing) is changed from 67.5° C. to 80° C. Then, the toner is evaluated in the same manner as in Example 1. The results are shown in Table 1.

Example 5

In Example 5, a toner is produced in the same manner as in Example 1, except that the stirring rotation in the process to promote growth of the aggregated particles described in Example 1 (process for promoting aggregation) is changed from 810 rpm to 640 rpm, and the temperature of the process to coalesce the aggregate particles (process for coalescing) is changed from 67.5° C. to 76.5° C. Then, the toner is evaluated in the same manner as in Example 1. The results are shown in Table 1.

Example 6

In Example 6, a toner is produced in the same manner as in Example 1, except that the stirring rotation in the process to promote growth of the aggregated particles described in Example 1 (process for promoting aggregation) is changed from 810 rpm to 660 rpm, and the temperature of the process to coalesce the aggregate particles (process for coalescing) is changed from 67.5° C. to 74° C. Then, the toner is evaluated in the same manner as in Example 1. The results are shown in Table 1.

Example 7

In Example 7, a toner is produced in the same manner as in Example 1, except that the stirring rotation in the process to promote growth of the aggregated particles described in Example 1 (process for promoting aggregation) is changed from 810 rpm to 750 rpm, and the temperature of the process to coalesce the aggregate particles (process for coalescing) is changed from 67.5° C. to 70.5° C. Then, the toner is evaluated in the same manner as in Example 1. The results are shown in Table 1.

Example 8

In Example 8, a toner is produced in the same manner as in Example 1, except that the stirring rotation in the process to promote growth of the aggregated particles described in Example 1 (process for promoting aggregation) is changed from 810 rpm to 770 rpm, and the temperature of the process to coalesce the aggregate particles (process for coalescing) is changed from 67.5° C. to 69° C. Then, the toner is evaluated in the same manner as in Example 1. The results are shown in Table 1.

Example 9

In Example 9, a toner is produced in the same manner as in Example 1, except that the stirring rotation in the process to promote growth of the aggregated particles described in Example 1 (process for promoting aggregation) is changed from 810 rpm to 860 rpm, and the temperature of the process to coalesce the aggregate particles (process for coalescing) is changed from 67.5° C. to 66.5° C. Then, the toner is evaluated in the same manner as in Example 1. The results are shown in Table 1.

Example 10

In Example 10, a toner is produced in the same manner as in Example 1, except that the stirring rotation in the process to promote growth of the aggregated particles described in Example 1 (process for promoting aggregation) is changed from 810 rpm to 910 rpm, and the temperature of the process to coalesce the aggregate particles (process for coalescing) is changed from 67.5° C. to 64.5° C. Then, the toner is evaluated in the same manner as in Example 1. The results are shown in Table 1.

Example 11

In Example 11, a toner is produced in the same manner as in Example 1, except that the stirring rotation in the process to promote growth of the aggregated particles described in Example 1 (process for promoting aggregation) is changed from 810 rpm to 1020 rpm, and the temperature of the process to coalesce the aggregate particles (process for coalescing) is changed from 67.5° C. to 63° C. Then, the toner is evaluated in the same manner as in Example 1. The results are shown in Table 1.

Example 12

In Example 12, a toner is produced in the same manner as in Example 1, except that the stirring rotation in the process to promote growth of the aggregated particles described in Example 1 (process for promoting aggregation) is changed from 810 rpm to 1170 rpm, and the temperature of the process to coalesce the aggregate particles (process for coalescing) is changed from 67.5° C. to 62° C. Then, the toner is evaluated in the same manner as in Example 1. The results are shown in Table 1.

Example 13

In Example 13, a toner is produced in the same manner as in Example 1, except that the stirring rotation in the process to promote growth of the aggregated particles described in Example 1 (process for promoting aggregation) is changed from 810 rpm to 1400 rpm, and the temperature of the process to coalesce the aggregate particles (process for coalescing) is changed from 67.5° C. to 61° C. Then, the toner is evaluated in the same manner as in Example 1. The results are shown in Table 1.

Example 14

In Example 14, a toner is produced in the same manner as in Example 1, except that the stirring rotation in the process to promote growth of the aggregated particles described in Example 1 (process for promoting aggregation) is changed from 810 rpm to 1540 rpm, and the temperature of the process to coalesce the aggregate particles (process for coalescing) is changed from 67.5° C. to 81° C. Then, the toner is evaluated in the same manner as in Example 1. The results are shown in Table 1.

Example 15

In Example 15, a toner is produced in the same manner as in Example 1, except that the stirring rotation in the process to promote growth of the aggregated particles described in Example 1 (process for promoting aggregation) is changed from 810 rpm to 1390 rpm, and the temperature of the process to coalesce the aggregate particles (process for coalescing) is changed from 67.5° C. to 79.5° C. Then, the toner is evaluated in the same manner as in Example 1. The results are shown in Table 1.

Example 16

In Example 16, a toner is produced in the same manner as in Example 1, except that the stirring rotation in the process to promote growth of the aggregated particles described in Example 1 (process for promoting aggregation) is changed from 810 rpm to 1170 rpm, and the temperature of the process to coalesce the aggregate particles (process for coalescing) is changed from 67.5° C. to 76.5° C. Then, the toner is evaluated in the same manner as in Example 1. The results are shown in Table 1.

Example 17

In Example 17, a toner is produced in the same manner as in Example 1, except that the stirring rotation in the process to promote growth of the aggregated particles described in Example 1 (process for promoting aggregation) is changed from 810 rpm to 1020 rpm, and the temperature of the process to coalesce the aggregate particles (process for coalescing) is changed from 67.5° C. to 74° C. Then, the toner is evaluated in the same manner as in Example 1. The results are shown in Table 1.

Example 18

In Example 18, a toner is produced in the same manner as in Example 1, except that the stirring rotation in the process to promote growth of the aggregated particles described in Example 1 (process for promoting aggregation) is changed from 810 rpm to 910 rpm, and the temperature of the process to coalesce the aggregate particles (process for coalescing) is changed from 67.5° C. to 70.5° C. Then, the toner is evaluated in the same manner as in Example 1. The results are shown in Table 1.

Example 19

In Example 19, a toner is produced in the same manner as in Example 1, except that the stirring rotation in the process to promote growth of the aggregated particles described in Example 1 (process for promoting aggregation) is changed from 810 rpm to 860 rpm, and the temperature of the process to coalesce the aggregate particles (process for coalescing) is changed from 67.5° C. to 69° C. Then, the toner is evaluated in the same manner as in Example 1. The results are shown in Table 1.

Example 20

In Example 20, a toner is produced in the same manner as in Example 1, except that the stirring rotation in the process to promote growth of the aggregated particles described in Example 1 (process for promoting aggregation) is changed from 810 rpm to 770 rpm, and the temperature of the process to coalesce the aggregate particles (process for coalescing) is changed from 67.5° C. to 66.5° C. Then, the toner is evaluated in the same manner as in Example 1. The results are shown in Table 1.

Example 21

In Example 21, a toner is produced in the same manner as in Example 1, except that the stirring rotation in the process to promote growth of the aggregated particles described in Example 1 (process for promoting aggregation) is changed from 810 rpm to 750 rpm, and the temperature of the process to coalesce the aggregate particles (process for coalescing) is changed from 67.5° C. to 64.5° C. Then, the toner is evaluated in the same manner as in Example 1. The results are shown in Table 1.

Example 22

In Example 22, a toner is produced in the same manner as in Example 1, except that the stirring rotation in the process to promote growth of the aggregated particles described in Example 1 (process for promoting aggregation) is changed from 810 rpm to 660 rpm, and the temperature of the process to coalesce the aggregate particles (process for coalescing) is changed from 67.5° C. to 63° C. Then, the toner is evaluated in the same manner as in Example 1. The results are shown in Table 1.

Example 23

In Example 23, a toner is produced in the same manner as in Example 1, except that the stirring rotation in the process to promote growth of the aggregated particles described in Example 1 (process for promoting aggregation) is changed from 810 rpm to 640 rpm, and the temperature of the process to coalesce the aggregate particles (process for coalescing) is changed from 67.5° C. to 62° C. Then, the toner is evaluated in the same manner as in Example 1. The results are shown in Table 1.

Example 24

In Example 24, a toner is produced in the same manner as in Example 1, except that the stirring rotation in the process to promote growth of the aggregated particles described in Example 1 (process for promoting aggregation) is changed from 810 rpm to 520 rpm, and the temperature of the process to coalesce the aggregate particles (process for coalescing) is changed from 67.5° C. to 61° C. Then, the toner is evaluated in the same manner as in Example 1. The results are shown in Table 1.

Comparative Example 1

In Comparative Example 1, a toner is produced in the same manner as in Example 1, except that the amounts of the dispersions of first and second binder resin particles according to the production of brightness toner as described in Example 1, are changed to 243.3 parts and 6.8 parts, respectively. Then, the toner is evaluated in the same manner as in Example 1. The results are shown in Table 1.

Comparative Example 2

In Comparative Example 2, a toner is produced in the same manner as in Example 1, except that the second aggregated particle dispersion described in Example 1 is not used and the amount of the 10% aqueous nitric acid solution of polyaluminum chloride as an aggregation argent described in Example 1 is changed to 0.88 parts. Then, the toner is evaluated in the same manner as in Example 1. The results are shown in Table 1.

TABLE 1

| Example No. | Proportion of toner particles not including photoluminescent pigment (% by number) | Ratio (A/B) | Proportion of pigments within ±30° (% by number) | Ratio (C/D) | Glitter | Transferability |
|---|---|---|---|---|---|---|
| Example 1 | 25 | 61 | 85 | 0.074 | 5 | 96% |
| Example 2 | 5.6 | 61 | 85 | 0.074 | 3 | 83% |

TABLE 1-continued

| Example No. | Proportion of toner particles not including photoluminescent pigment (% by number) | Ratio (A/B) | Proportion of pigments within ±30° (% by number) | Ratio (C/D) | Glitter | Transferability |
|---|---|---|---|---|---|---|
| Example 3 | 78 | 61 | 85 | 0.074 | 3 | 82% |
| Example 4 | 25 | 3 | 61 | 0.452 | 2 | 91% |
| Example 5 | 25 | 19 | 67 | 0.215 | 2 | 92% |
| Example 6 | 25 | 22 | 72 | 0.191 | 3 | 92% |
| Example 7 | 25 | 38 | 79 | 0.110 | 3 | 90% |
| Example 8 | 25 | 43 | 82 | 0.093 | 4 | 93% |
| Example 9 | 25 | 79 | 87 | 0.055 | 4 | 91% |
| Example 10 | 25 | 82 | 91 | 0.040 | 3 | 90% |
| Example 11 | 25 | 87 | 94 | 0.020 | 3 | 92% |
| Example 12 | 25 | 91 | 96 | 0.008 | 2 | 91% |
| Example 13 | 25 | 98 | 98 | 0.002 | 2 | 90% |
| Example 14 | 25 | 61 | 58 | 0.0008 | 5 | 94% |
| Example 15 | 25 | 61 | 61 | 0.002 | 4 | 95% |
| Example 16 | 25 | 61 | 67 | 0.008 | 4 | 95% |
| Example 17 | 25 | 61 | 72 | 0.020 | 4 | 94% |
| Example 18 | 25 | 61 | 79 | 0.040 | 4 | 93% |
| Example 19 | 25 | 61 | 82 | 0.055 | 5 | 95% |
| Example 20 | 25 | 61 | 87 | 0.093 | 5 | 94% |
| Example 21 | 25 | 61 | 91 | 0.110 | 4 | 92% |
| Example 22 | 25 | 61 | 94 | 0.191 | 4 | 91% |
| Example 23 | 25 | 61 | 96 | 0.215 | 4 | 93% |
| Example 24 | 25 | 61 | 98 | 0.452 | 4 | 92% |
| Comparative Example 1 | 4.5 | 61 | 85 | 0.074 | 1 | 73% |
| Comparative Example 2 | 0 | 61 | 85 | 0.074 | 5 | 60 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic image developing toner comprising:

first toner particles which contain a first binder resin and a brightness pigment, the first toner particles having a flat shape; and second toner particles which contain a second binder resin and have a substantial spherical shape, wherein a proportion of the second toner particles is in a range from 5% by number to 80% by number with respect to a total number of all toner particles, wherein the electrostatic image developing toner satisfies the following formula:

Formula: $2 \leq A/B \leq 100$ wherein A represents a reflectance at an acceptance angle of +30° and B represents a reflectance at an acceptance angle of −30°, both of the reflectances being measured when light is irradiated at an incidence angle of −45° onto a solid image formed with the electrostatic image developing toner by using a goniophotometer, and wherein a ratio of average maximum thickness C to average equivalent circle diameter D (C/D) of the first toner particles is a range from 0.010 to 0.200.

2. The electrostatic image developing toner according to claim 1, wherein the proportion of the second toner particles is in a range from 10% by number to 50% by number with respect to the total number of all toner particles.

3. The electrostatic image developing toner according to claim 1, wherein the proportion of the second toner particles is in a range from 15% by number to 40% by number with respect to the total number of all toner particles.

4. The electrostatic image developing toner according to claim 1, wherein the brightness pigment is in rod shape.

5. The electrostatic image developing toner according to claim 1, which satisfies $20 \leq A/B \leq 90$.

6. The electrostatic image developing toner according to claim 1, wherein the first binder resin is the same as the second binder resin.

7. An electrostatic image developer comprising the electrostatic image developing toner according to claim 1.

8. The electrostatic image developer according to claim 7, wherein the proportion of the second toner particles is in a range from 10% by number to 50% by number with respect to the total number of all toner particles.

9. An image forming method comprising:

charging a surface of an image holding member;

forming an electrostatic latent image on the surface of the image holding member;

developing the electrostatic latent image formed on the surface of the image holding member by using a developer to form a toner image; and transferring the toner image onto a transfer-receiving member, wherein the developer is the electrostatic image developer according to claim 7.

10. The image forming method according to claim 9, wherein the proportion of the second toner particles is in a range from 10% by number to 50% by number with respect to the total number of all toner particles.

* * * * *